US009205643B2

(12) United States Patent
Nagoshi et al.

(10) Patent No.: US 9,205,643 B2
(45) Date of Patent: Dec. 8, 2015

(54) METHOD FOR MANUFACTURING PRINTED PRODUCTS USING INDUSTRIAL INKJET PRINTER

(71) Applicant: MITSUBISHI PAPER MILLS LIMITED, Tokyo (JP)

(72) Inventors: Masanori Nagoshi, Tokyo (JP); Koji Idei, Tokyo (JP); Jun Urasaki, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 14/434,822

(22) PCT Filed: Oct. 8, 2013

(86) PCT No.: PCT/JP2013/077367

§ 371 (c)(1),
(2) Date: Apr. 10, 2015

(87) PCT Pub. No.: WO2014/057944

PCT Pub. Date: Apr. 17, 2014

(65) Prior Publication Data

US 2015/0273819 A1 Oct. 1, 2015

(30) Foreign Application Priority Data

Oct. 11, 2012 (JP) ..... 2012-225670
Aug. 9, 2013 (JP) ..... 2013-165744

(51) Int. Cl.
*B41M 5/40* (2006.01)
*B41J 2/01* (2006.01)

(52) U.S. Cl.
CPC ..... *B41J 2/01* (2013.01)

(58) Field of Classification Search
CPC ..... B41M 5/506; B41M 5/5218; B41M 2205/40; B41M 5/40; D21H 19/385; G03C 1/76; Y10T 428/24893; Y10T 428/24934; Y10T 428/273; Y10T 428/31993
See application file for complete search history.

(56) References Cited

U.S. PATENT DOCUMENTS 8,567,944 B2 * 10/2013 Swei ..... 347/105

FOREIGN PATENT DOCUMENTS

| | | | |
|---|---|---|---|
| JP | 2003-285533 | A | 10/2003 |
| JP | 2004-114487 | A | 4/2004 |
| JP | 2004-232150 | A | 8/2004 |
| JP | 2004-237650 | A | 8/2004 |
| JP | 2004-276519 | A | 10/2004 |
| JP | 2005-88525 | A | 4/2005 |
| JP | 2011-251231 | A | 12/2011 |

OTHER PUBLICATIONS

Michiko Tokumasu "Inkjet Printer Compatible with B2 Wide Format Printing Paper" Japan Printer, Insatsu Gakkai Shuppanbu Ltd., Aug. 2010, vol. 93, pp. 21-24.
Yasutoshi Miyagi "Offset Quality Injket Printer" Japan Printer, Insatsu Gakkai Shuppanbu Ltd., Aug. 2010, vol. 93, pp. 25-29.

* cited by examiner

*Primary Examiner* — Thinh Nguyen
(74) *Attorney, Agent, or Firm* — Birch, Stewart, Kolasch & Birch, LLP

(57) ABSTRACT

The present invention provides a method for manufacturing printed products using an industrial inkjet printer and the method does not generate soiling of the images and printing unevenness. The present invention provides a method for manufacturing a printed product using an industrial inkjet printer, comprising: a step for printing on coated printing paper using an industrial inkjet printer, wherein the printing speed of the industrial inkjet printer is 60 m/min or more, the coated printing paper contains a support and a coating layer, and the coating layer contains ground calcium carbonate, having a cumulative frequency of a particle diameter of 1.0 μm or less in a volume-based particle size distribution of 95% by volume or more and a mean particle diameter of 0.1 μm to 0.28 μm, at 60% by mass or more of the total amount of pigment in the coating layer.

10 Claims, 1 Drawing Sheet

METHOD FOR MANUFACTURING PRINTED PRODUCTS USING INDUSTRIAL INKJET PRINTER

TECHNICAL FIELD

The present invention relates to a method for manufacturing printed products using an industrial inkjet printer.

BACKGROUND ART

The technology of inkjet recording systems has progressed rapidly, and industrial inkjet printers are known that employ inkjet recording systems in industrial or commercial printers for manufacturing large volumes of commercial printed products (see, for example, Patent documents 1 and 2 and Non-patent documents 1 and 2). Industrial inkjet printers are marketed under trade names such as Truepress Jet manufactured by Dainippon Screen Mfg. Co., Ltd., the MJP Series manufactured by Miyakoshi Printing Machinery Co., Ltd., Prosper and Versamark manufactured by Eastman Kodak Co., and JetPress manufactured by Fujifilm Corp.

Although dependent on various printing conditions, these industrial inkjet printers feature color printing speeds that are ten to several tens of times faster than inkjet printers for home and SOHO use as well as wide format inkjet printers, demonstrating printing speeds of 15 m/min or faster and exceeding 60 m/min in the case of high-speed printers. Consequently, industrial inkjet printers are distinguished from inkjet printers for home and SOHO use and wide format inkjet printers.

Since industrial inkjet printers are able to handle variable information, they can be adapted to on-demand printing. There are many cases in which printing firms adopt a system by which fixed information is printed with conventional printers such as gravure printers, offset printers, letterpress printers, flexographic printers, thermal transfer printers or toner printers, and variable information is printed with industrial inkjet printers.

However, coated paper for offset printing and other conventional coated printing paper have inadequate printability with respect to, for example, inadequate ink fixation or ink absorption capacity for industrial inkjet printers. Consequently, image soiling and other problems occur, thereby preventing the obtaining of adequate image quality for marketing as a commercial product. Conventional inkjet printer paper has inadequate printability with respect to, for example, inadequate coating layer strength for offset printers and other conventional printers. Consequently, printing defects such as blanket piling occur during use with offset printers, thereby preventing the obtaining of adequate image quality for marketing as a commercial product. In addition, since conventional inkjet printer paper is not manufactured for use at printing speeds like those of industrial inkjet printers, they have inadequate printability in terms of inadequate ink adsorption rate or inadequate dot diffusion of ink droplets for industrial inkjet printers. Consequently, image soiling or white streaks on solid printed regions occur, thereby preventing the obtaining of adequate image quality for marketing as a commercial product.

Here, dot diffusion refers to a level of quality in which gaps between ink droplets are filled in as a result of ink droplets adequately diffusing after having impacted coated paper.

PRIOR ART DOCUMENTS

Patent Documents

Patent document 1: Japanese Unexamined Patent Publication No. 2011-251231

Patent document 2: Japanese Unexamined Patent Publication No. 2005-088525

Non-Patent Documents

Non-patent document 1: Michiko Tokumasu: "Inkjet Printer Compatible with B2 Wide Format Printing Paper" (Japan Printer, Insatsu Gakkai Shuppanbu Ltd., August 2010 (Vol. 93), pp. 21-24)

Non-patent document 2: Yasutoshi Miyagi: "Offset Quality Inkjet Printer" (Japan Printer, Insatsu Gakkai Shuppanbu Ltd., August 2010 (Vol. 93), pp. 25-29)

DISCLOSURE OF THE INVENTION

Problems to be Solved by the Invention

Due to the aforementioned problems, a method for manufacturing printed products capable of being marketed as commercial products using an industrial inkjet printer has yet to be adequately established. Moreover, a method for manufacturing printed products capable of being marketed as commercial products that have adequate image quality as a commercial product by using an industrial inkjet printer while also having adequate image quality as a commercial product by using a conventional printer, has yet to be adequately established. In particular, a method for manufacturing printed products capable of being marketed as commercial products such as brochures, catalogs or pamphlets, which require a higher level of image quality in comparison with advertising leaflets and the like that are unconcerned with image quality, has also yet to be adequately established.

A first object of the present invention is to provide a method for manufacturing printed products capable of being marketed as commercial products using an industrial inkjet printer.

A second object of the present invention is to provide a method for manufacturing printed products capable of being marketed as commercial products by printing using a conventional printer before or after printing using an industrial inkjet printer.

Means for Solving the Problems

The first object of the present invention is achieved by a method for manufacturing printed products using an industrial inkjet printer that includes a step for printing on coated printing paper using an industrial inkjet printer, wherein the printing speed of the industrial inkjet printer is 60 m/min or more, the coated printing paper contains a support and a coating layer, and the coating layer contains ground calcium carbonate, having a cumulative frequency of a particle diameter of 1.0 μm or less in a volume-based particle size distribution of 95% by volume or more and a mean particle diameter of 0.1 μm to 0.28 μm, at 60% by mass or more of the total amount of pigment in the coating layer.

As a result, printed products capable of being marketed as commercial products can be manufactured using an industrial inkjet printer.

The second object of the present invention is achieved by the aforementioned method for manufacturing printed products using an industrial inkjet printer, which further includes a step for printing using a printer other than the industrial inkjet printer, selected from a gravure printer, offset printer, letterpress printer, flexographic printer, thermal transfer printer and toner printer, before or after the step for printing on the coated printing paper using an industrial inkjet printer.

As a result, printed products capable of being marketed as commercial products can be manufactured by printing fixed information using a conventional printer such as a gravure printer, offset printer, letterpress printer, flexographic printer, thermal transfer printer or toner printer, and printing variable information using an industrial inkjet printer.

BEST MODE FOR CARRYING OUT THE INVENTION

Figure 1:
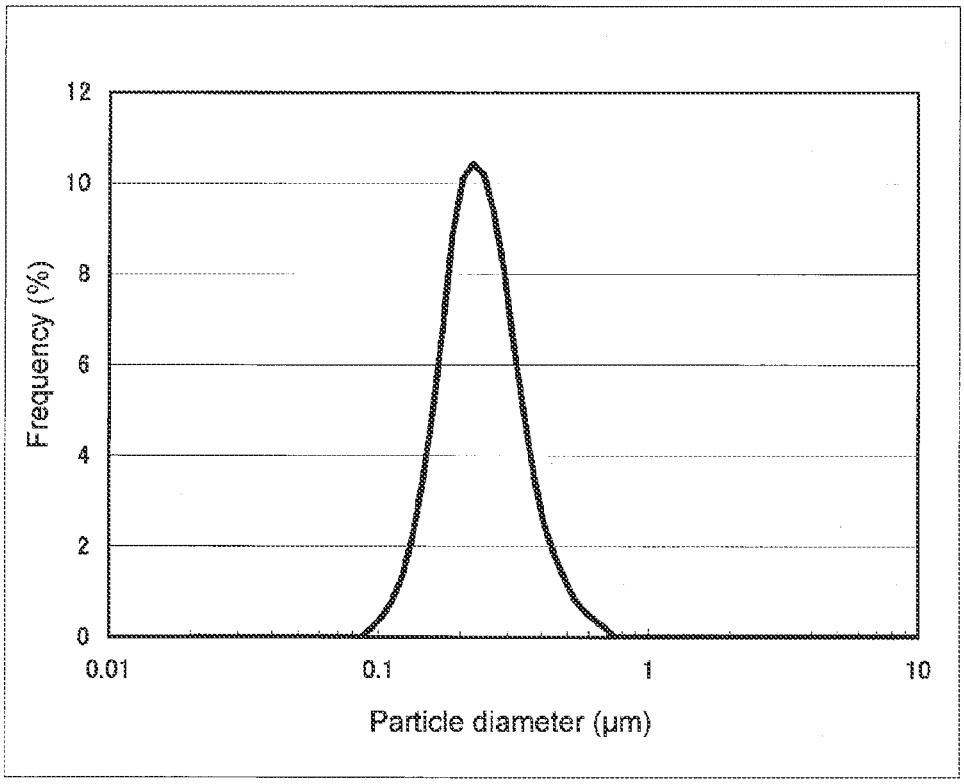
FIG. 1 shows a particle size distribution chart of ground calcium carbonate equivalent to "ground calcium carbonate 1b" of the examples.

The following provides a detailed explanation of the present invention.

Industrial inkjet printers consist of rotary printing paper types and cut sheet types according to the difference in the manner in which the paper is fed. The types of ink installed consist of water-based dye ink, in which a dye is used for the colorant, and water-based pigment ink, in which a pigment is used for the colorant. In the present invention, there are no particular limitations on the manner in which paper is fed or on the ink type of the industrial inkjet printer.

In the case both variable information and fixed information are present in an image to be printed, all or a portion of the fixed information is preferably printed using a conventional printer such as a gravure printer, offset printer, letterpress printer, flexographic printer, thermal transfer printer or toner printer. An offset printer is particularly preferable from the viewpoint of manufacturing cost and print quality. Printing with a conventional printer may be carried out before or after the step for printing using an industrial inkjet printer. In the case image areas of variable information and fixed information are overlapping, since there are cases in which the portion for industrial inkjet printing is covered by ink of the conventional printer making it difficult to recognize visually, printing using an industrial inkjet printer is preferably carried out afterwards. However, if printing using a conventional printer is carried out prior to printing using an industrial inkjet printer, there are cases in which the ink absorption capacity of the coated paper may be insufficient due to the coating layer of the coated paper being covered by ink of the conventional printer. Thus, it is necessary to further enhance the ink absorption capacity of the coated paper with respect to the industrial inkjet printer.

In the present invention, the conventional printer is, for example, a gravure printer, offset printer, letterpress printer, flexographic printer, thermal transfer printer or toner printer.

Gravure printers are printers that employ a process by which ink is transferred to a printing substrate via a roll-shaped plate cylinder having an image engraved therein.

Offset printers are printers that employ an indirect printing process by which ink is first transferred to a blanket and the transferred ink is then transferred to a printing substrate.

Letterpress printers are printers that employ a relief printing process by which ink imparted to a relief printing plate is subjected to pressure while being pressed against a printing substrate.

Flexographic printers are printers that employ a relief printing process using a flexible, elastic resin plate.

Thermal transfer printers are printers that use various colors of ink ribbons and employ a process by which a colorant is transferred from an ink ribbon to the printing substrate by heat.

Toner printers are printers that employ an electro graphic process by which toner adhered to an electrostatic drum is transferred to a printing substrate utilizing static electricity.

In the present invention, "adequate image quality for marketing as a commercial product" refers to the absence of the occurrence of soiling of the images of printed products caused by separation of the coating layer, defective ink fixation or defective toner fixation following printing, or soiling or bleeding of images of printed products caused by insufficient ink absorption rate or ink absorption capacity. Moreover, "adequate image quality for marketing as a commercial product" includes the absence of the occurrence of white streaks in the printed portions of printed products caused by defective dot diffusion of ink droplets that have impacted a printing substrate in the case of industrial inkjet printers, as well as the absence of the occurrence of blanket piling in the case of offset printers. "Printed products capable of being marketed as commercial products" refer to printed products having "adequate image quality for marketing as a commercial product".

The method for manufacturing printed products using an industrial inkjet printer of the present invention includes a step for printing onto coated printing paper using an industrial inkjet printer.

In the present invention, the printing speed of the industrial inkjet printer is 60 m/min or more. Although industrial inkjet printing is possible even at a printing speed slower than the aforementioned printing speed, the printing speed at which the effects of the present invention are prominently observed is 60 m/min or more. The printing speed is preferably 100 m/min or more and more preferably 150 m/min or more in order to improve the production efficiency of printed products. In the case of cut sheets, printing speed is calculated from the paper size printed per minute.

Coated printing paper includes a support and a coating layer. As a result of having a coating layer, texture can be obtained that is comparable to that of offset printing paper in the form of CWF paper.

The coating layer of the present invention contains ground calcium carbonate having a cumulative frequency of a particle diameter of 1.0 μm or less in a volume-based particle size distribution of 95% by volume or more and a mean particle diameter of 0.1 μm to 0.28 μm.

In the present invention, the ground calcium carbonate preferably does not contain particles having a particle diameter greater than 1.5 μm. The reason for this is that the occurrence of image soiling of printed products in industrial inkjet printing can be further inhibited.

As used herein, particle size distribution refers to particle size distribution based on volume as measured with a laser diffraction/scattering particle size distribution analyzer. Mean particle diameter refers to mean particle diameter based on measurement of volume-based particle size distribution using a laser diffraction/scattering method or dynamic light scattering method. Mean particle diameter refers to the mean particle diameter of single particles in the case of single particles, or mean particle diameter of aggregated particles in the case of forming secondary particles or other aggregated particles. Mean particle diameter, cumulative frequency and the half value width of the maximum peak on a particle size distribution curve can be calculated from the resulting particle size distribution. For example, particle size distribution, mean particle diameter, cumulative frequency and half value width of the maximum peak on a particle size distribution curve can be calculated by measuring particle size distribution using the Microtrac MT3300EXII laser diffraction/scattering particle size distribution analyzer manufactured by Nikkiso Co., Ltd.

The mean particle diameter, cumulative frequency and half value width of the maximum peak on a particle size distribution curve of ground calcium carbonate can also be determined from the state in which it has become coated paper. An example of a method thereof consists of capturing an electron micrograph of the surface of the coated printing paper using a scanning electron microscope equipped with an elemental analysis function such as an energy dispersive X-ray spectrometer, calculating particle diameter of the photographed particles by assuming the photographed particles as spheres having cross-section areas approximately equal to the particle image areas shown in the photographed image, and measuring 100 particles present in a photographed image to determine a mean particle diameter. A particle size distribution curve, in which frequency (%) is plotted on the vertical axis and particle diameter (μm) is plotted on the horizontal axis, can be obtained from particle diameter data measured from 100 particles using particle image analysis software. Half value width can be determined from the resulting particle size distribution curve as the width at ½ the height of the peak height of the maximum peak.

The maximum peak refers to a single peak or the highest peak among a plurality of peaks. When the half value width of the maximum peak is small, it means that the particle size distribution curve has a well-defined maximum peak.

In the case the cumulative frequency or mean particle diameter of the ground calcium carbonate does not fall within the aforementioned ranges, adequate image quality for marketing as a commercial product cannot be obtained for printed products manufactured using an industrial inkjet printer.

In the present invention, the ground calcium carbonate having a cumulative frequency of a particle diameter of 1.0 μm or less in a volume-based particle size distribution of 95% by volume or more and a mean particle diameter of 0.1 μm to 0.28 μm preferably has at least one peak and the half value width of the maximum peak of 0.25 μm or less in a particle size distribution curve thereof. As a result of the half value width satisfying this condition, printed products printed using an industrial inkjet printer having adequate image quality for marketing as a commercial product can be more favorably obtained. As a result, printed articles capable of being marketed as commercial products can be more favorably manufactured.

Figure 2:
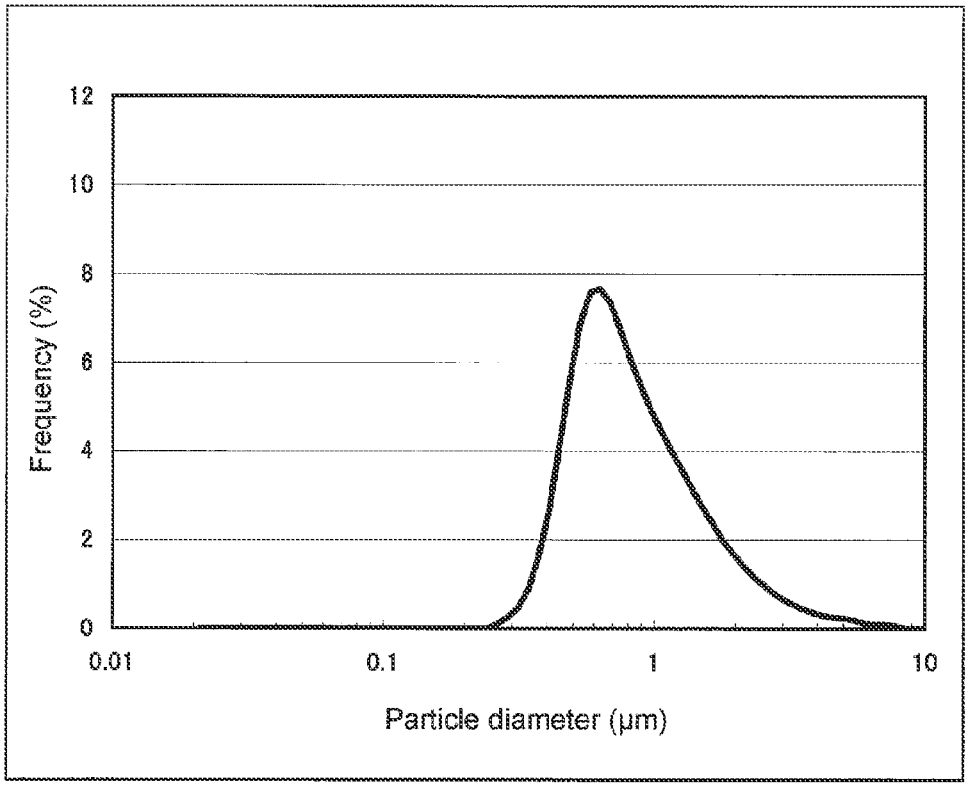
FIG. 2 shows a particle size distribution chart of a commercially available ground calcium carbonate product equivalent to "ground calcium carbonate 13" of the examples.

FIG. 1 indicates an example of a particle size distribution curve of ground calcium carbonate that has a cumulative frequency of a particle diameter of 1.0 μm or less in a volume-based particle size distribution of 95% by volume or more and a mean particle diameter of 0.1 μm to 0.28 μm, has at least one peak, and has a half value width of the maximum peak of 0.25 μm or less. FIG. 2 indicates an example of a particle size distribution curve of ground calcium carbonate conventionally known in the field of coated paper.

Ground calcium carbonate is manufactured by crushing natural limestone. Thus, even though mean particle diameter may be roughly the same, particle size distribution is not the same. In general, ground calcium carbonate demonstrates a particle size distribution curve that does not have a well-defined peak or has a broad peak. The ground calcium carbonate according to the present invention is distinguished from conventionally known ground calcium carbonate in that it consists of fine particles such that the mean particle diameter is 0.1 μm to 0.28 μm and the cumulative frequency of a particle diameter of 1.0 μm or less is 95% by volume or more, and has a well-defined maximum peak.

In the present invention, the coating layer can contain a conventionally known pigment in addition to the ground calcium carbonate. Examples of conventionally known pigments include various types of kaolin, clay, talc, precipitated calcium carbonate, satin white, lithopone, titanium dioxide, zinc oxide, silica, colloidal silica, alumina, aluminum hydroxide and plastic pigments.

In the present invention, the content of the ground calcium carbonate according to the present invention in the coating layer is 60% by mass or more of the total amount of pigment in the coating layer. If the ground calcium carbonate in the coating layer is less than 60% by mass of the total amount of pigment in the coating layer, ink fixation on the coated paper with respect to an industrial inkjet printer is defective and the ink absorption rate is insufficient, thereby preventing manufactured printed products from having adequate image quality for marketing as a commercial product.

The ground calcium carbonate according to the present invention can be manufactured using, for example, the method indicated below. First, a preliminary dispersed slurry of ground calcium carbonate is prepared by dispersing a powder, obtained by dry-crushing natural limestone, in water or an aqueous solution to which has been added a dispersant. The preliminary dispersed slurry prepared in this manner is then further wet-crushed using a bead mill and the like. Here, the natural limestone can also be wet-crushed directly. However, dry crushing is preferably carried out in advance prior to wet crushing from the viewpoint of productivity. During dry crushing, the natural limestone is crushed preferably to a degree that the particle diameter thereof is 40 mm or less, and more preferably to a mean particle diameter of 2 μm to 2 mm. During wet crushing, particle diameter is preferably adjusted by carrying out granulating the particle size at an intermediate stage. Granulating can be carried out with a commercially available granulating machine.

Next, an organic dispersant is preferably applied to the surface of the aforementioned crushed limestone. Although this can be carried out by various methods, it is preferably carried out by a method consisting of wet crushing the dry-crushed limestone in the presence of an organic dispersant. More specifically, an aqueous medium is added to the limestone such that the weight ratio of limestone/aqueous medium (preferably water) is 30/70 to 85/15 and preferably 60/40 to 80/20 followed by addition of the organic dispersant thereto. Examples of organic dispersants include low molecular weight or high molecular weight water-soluble anionic surfactants having a carboxylate, sulfate, sulfonate or phosphate group as a functional group thereof, and polyethylene glycol-based or polyhydric alcohol-based nonionic surfactants. The organic dispersant is particularly preferably a water-soluble anionic surfactant having polyacrylic acid in the form of a polyacrylic acid-based organic dispersant. These organic dispersants are commercially available from manufacturers such as San Nopco Ltd., Toagosei Co., Ltd. or Kao Corp., and these can be used in the present invention. Although there are no particular limitations on the amount of organic dispersant used, it is preferably used within a range of 0.3 parts by mass to 3.5 parts by mass, and more preferably used within a range of 0.5 parts by mass to 3 parts by mass, as the solid fraction per 100 parts by mass of the ground calcium carbonate. The resulting preliminary dispersed slurry is wet-crushed according to a conventionally known method. Alternatively, an aqueous medium, obtained by preliminarily dissolving an organic. dispersant in an amount within the aforementioned range, is mixed with limestone followed by wet-crushing according to a conventionally known method. Wet crushing can be carried out in batches or continuously with an apparatus such as a mill that uses a crushing medium in the manner of a sand mill, attritor or ball mill and the like. As a result of wet crushing in this manner followed by granulating to obtain the prescribed cumulative frequency, ground calcium carbonate can be obtained having a cumulative frequency of a particle diameter of 1.0 μm or less in a volume-based particle size distribution of 95% by volume or more and a mean particle diameter of 0.1 μm to 0.28 μm. Moreover, by granulating to obtain the prescribed half value width, ground calcium carbonate can be obtained in which the particle size distribution curve thereof has at least one peak and the half value width of the maximum peak is 0.25 μm or less. However, the method used to obtain ground calcium carbonate having a cumulative frequency and mean particle diameter according to the present invention is not limited to the aforementioned method.

The coating layer of the coated printing paper used in the present invention preferably contains a conventionally known binder used in coated paper. The reason for this is that strength of the coating layer is improved by containing a binder. As a result, more favorable printed products can be manufactured using an industrial inkjet printer and a conventional printer such as an offset printer. Examples of conventionally known binders used in the coating layer of coated paper include polyacrylic acid-based binders such as sodium polyacrylate or polyacrylamide, polyvinyl acetate-based binders, various types of copolymer latex such as styrene-butadiene copolymer or ethylene-vinyl acetate, polyvinyl alcohol, denatured polyvinyl alcohol, polyethylene oxide, formalin resins such as urea or melamine, and water-soluble synthetic products such as polyethyleneimine, polyamidopolyamine or epichlorhydrin. Additional examples of binders include starches purified from natural plants, hydroxyethyl starch, oxidized starch, starch ether, starch phosphate, enzyme modified starch and cold water-soluble starch obtained by flash drying the aforementioned starches, natural polysaccharides and oligomers thereof such as dextrin, mannan, chitosan, arabinogalactan, glycogen, inulin, pectin, hyaluronic acid, carboxymethyl cellulose or hydroxyethyl cellulose, and modified forms thereof. Other examples of binders include natural proteins and modified forms thereof such as casein, gelatin, soybean protein or collagen, and synthetic polymers and oligomers such as polylactic acid or peptides. These can be used alone or in combination. In addition, the binder can be used after undergoing cationic modification. Since there are cases in which image soiling occurs during industrial inkjet printing if the binder is incorporated in excess with respect to the pigment, the content of the binder in the coating layer is preferably 3 parts by mass to 30 parts by mass, and more preferably 5 parts by mass to 20 parts by mass, based on 100 parts by mass of the total amount of pigment in the coating layer.

Moreover, the coating layer preferably further contains a known printability improver conventionally used in an offset printer and the like. The reason for this is that image quality of printed products is easily stabilized in printing with an industrial inkjet printer or offset printer. Examples of printability improvers used in the coating layer of coated paper include melamine-formaldehyde-based resins, urea-formaldehyde-based resins, polyamine-based resins, polyamide-polyurea-based resins, polyamide-polyurea-formaldehyde-based resins, polyamide-formaldehyde-based resins, polyamide-epoxy-based resins, polyamide-epichlorhydrin-based resins, glyoxal-based resins, zirconium carbonate, glycerin diglycidyl ether, polyglycidyl ether, ketone-aldehyde-based resins and dialdehyde starch. These can be used alone or in combination. Polyamine-based resins are used preferably.

The content of printability improver in the coating layer is preferably 0.1 parts by mass to 3 parts by mass based on 100 parts by mass for the total amount of pigment in the coating layer.

The coating layer of coated paper used in the present invention can contain an additive in the form of various types of conventionally known assistants as necessary in addition to the ground calcium carbonate, binder and printability improver according to the present invention. Examples of various types of assistants include organic pigments, ink fixing agents, pigment dispersants, thickeners, fluidity improvers, surfactants, defoamers, antifoamers, releasing agents, foaming agents, penetrants, coloring dyes, coloring pigments, optical brighteners, ultraviolet absorbers, antioxidants, preservatives, fungicides, insolubilizers, wet paper strengthening agents and dry paper strengthening agents.

The coating layer of coated paper used in the present invention preferably contains an acetylene glycol derivative. An acetylene glycol derivative refers to a glycol having a structure in which an acetylene group is present in the center and an alkyl substituent and hydroxyl group are present on the left and right sides thereof, and examples thereof are described in Japanese Unexamined Patent Publication No. 2002-348500 and Japanese Unexamined Patent Publication No. 2003-49394.

As a result of the coating layer of the coated paper containing an acetylene glycol derivative, printed products manufactured using an industrial inkjet printer and offset printer have more favorable image quality that is adequate for marketing as a commercial product. The reason for this is that ink absorption rate is enhanced and coating layer strength is increased.

In the present invention, the acetylene glycol derivative is a compound represented by the following general formula (1) or (2).

[Chemical formula 1]

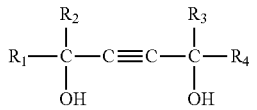

(1)

In the aforementioned formula (1), $R_1$, $R_2$, $R_3$ and $R_4$ respectively represent an alkyl group having 1 to 5 carbon atoms. $R_1$, $R_2$, $R_3$ and $R_4$ preferably have a bilaterally symmetrical structure centered about the acetylene group.

[Chemical formula 2]

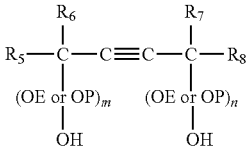

(2)

In the aforementioned formula (2), $R_5$, $R_6$, $R_7$ and $R_8$ respectively represent an alkyl group having 1 to 5 carbon atoms. m and n respectively represent an integer of 1 to 25, and m+n is 2 to 40. OE represents an oxyethylene chain (—O—$CH_2$—$CH_2$—), and OP represents an oxypropylene chain (—O—$CH_2$—CH[$CH_3$]—). OE and OP may respectively be single chains or mixed chains. $R_5$, $R_6$, $R_7$ and $R_8$ preferably have a bilaterally symmetrical structure centered about the acetylene group.

The acetylene glycol derivative according to the present invention is commercially available from Nissin Chemical Co., Ltd. under the trade name "Surfynol" or "Olfine", and from Kawaken Fine Chemicals Co., Ltd. under the trade name "Acetylenol".

In the present invention, preferable acetylene glycol derivatives are 2,4,7,9-tetramethyl-5-decyne-4,7-diol and 2,4,7,9-tetramethyl-5-decyne-4,7-diol ethoxylate.

In the present invention, the content of the acetylene glycol derivative in the coating layer is preferably 0.05% by mass to 1% by mass of the total amount of pigment in the coating layer. This is because, if the content of the acetylene glycol derivative is within this range, image bleeding is not induced and ink absorption rate and coating layer strength of the coated paper can be further enhanced.

In the present invention, the coated paper used can be obtained by coating a coating layer-coating color on a support and drying. An ordinarily used coating apparatus can be used in the method for coating the coating layer-coating color onto the support, and there are no particular limitations thereon. Examples thereof include various types of coating apparatuses such as a roll coater, air knife coater, bar coater, various types of blade coaters such as a rod blade coater, short dwell coater or curtain coater. An ordinarily used drying apparatus can be used in the drying method, and there are no particular limitations thereon. Examples thereof include various types of drying apparatuses such as hot air dryers such as a linear tunnel dryer, arch dryer, an air loop dryer or sine curve air float dryer, and dryers using infrared rays, heat dryer or microwaves.

The coated paper used in the present invention is provided with at least one layer of the coating layer according to the present invention. In the present invention, the coated paper preferably has the coating layer according to the present invention on both sides thereof. As a result of providing the coating layer on both sides, printed products can be manufactured that have a texture comparable to CWF paper on both sides thereof. A coating layer other than the coating layer according to the present invention can be suitably provided on the support side or surface layer side of the coating layer according to the present invention provided it does not impair the effects of the present invention.

In the present invention, the support of the coated paper used is raw paper, woodfree paper or conventional coated paper. Raw paper is manufactured by using wood pulp, in the manner of chemical pulp such as leaf bleached Kraft pulp (LBKP) or needle bleached Kraft pulp (NBKP), mechanical pulp such as groundwood pulp (GP), pressure groundwood pulp (PGW), refiner mechanical pulp (RMP), thermomechanical pulp (TMP), chemithermomechanical pulp (CTMP), chemimechanical pulp (CMP) or chemi-groundwood pulp (CGP), or waste paper pulp such as de-inked pulp (DIP), and a conventionally known filler as main components, mixing using one or more types of various types of additives such as binders, sizing agents, fixing agents, retention aids, cationizing agents or paper strengthening agents as necessary, and papermaking with various types of apparatuses such as a Fourdrinier papermaking machine, cylinder papermaking machine or twin wire papermaking machine. Woodfree paper is obtained by providing a size press coating or anchor coat layer using starch or polyvinyl alcohol and the like on the raw paper. Examples of conventional coated paper include art paper, coat paper, cast coat paper and Baryta paper obtained by further providing a coat layer on the raw paper or woodfree paper.

The coated printing paper of the present invention can be obtained by coating the coating layer-coating color onto a support followed by drying. An ordinarily used coating apparatus can be used in the method for coating the coating layer-coating color on the support, and there are no particular limitations thereon. Examples thereof include various types of coating apparatuses such as a roll coater, air knife coater, bar coater, various types of blade coaters such as a rod blade coater, short dwell coater and curtain coater. An ordinarily used drying apparatus can be used in the drying method, and there are no particular limitations thereon. Examples thereof include various types of drying apparatuses such as hot air dryers such as a linear tunnel dryer, arch dryer, an air loop dryer or sine curve air float dryer, and dryers using infrared rays, heat dryer or microwaves. Although the coated paper according to the present invention can be used as is after coating and drying, the surface can also be smoothened as necessary with a machine calender, soft nip calender, super calender, multistage calender or multi-nip calender and the like.

EXAMPLES

The following provides a more detailed explanation of the present invention through examples thereof. However, the present invention is not limited to the following examples provided the gist thereof is not exceeded. The terms parts by mass, percent by mass (mass %) and percent by volume (vol %) indicated in the examples indicate the values of dried solid fractions or substantial components.

<Measurement of Particle Size Distribution of Ground Calcium Carbonate>

The particle size distribution of ground calcium carbonate was measured under the following measurement conditions using the Microtrac MT3300EXII particle size distribution analyzer manufactured by Nikkiso Co., Ltd.

Solvent: Water

Particle refractive index: 1.65

Particle shape: Non-spherical

A volume-based particle size distribution curve and cumulative frequency curve were prepared with respect to particle diameter based on the measurement results, and mean particle diameter, cumulative frequency of a particle diameter of 1.0 μm or less and half value width of the maximum peak were calculated using an analyzing means provided with the measuring instrument. Mean particle diameter, cumulative frequency and half value width of the maximum peak were calculated for ground calcium carbonate and silica, while mean particle diameter was calculated for other materials.

[Preparation of Ground Calcium Carbonate]

<Production of Ground Calcium Carbonate 1a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 83% by volume. The flow rate was set to about 15 liters/min. The number of passes was set to 16. At this time, the mean particle diameter was 0.20 μm, the content of particles larger than 1.5 μM was zero, the cumulative frequency of ground calcium carbonate within a particle diameter range of 1.0 μm or less was 100% by volume, and the half value width of the maximum peak was 0.37 μm.

<Production of Ground Calcium Carbonate 1b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 83% by volume. The flow rate was set to about 15 liters/min. The number of passes was set to 16. At this time, the mean particle diameter was 0.20 μm, the content of particles larger than 1.5 μm was zero, the cumulative frequency of ground calcium carbonate within a particle diameter range of 1.0 μm or less was 100% by volume, and the half value width of the maximum peak was 0.19 μm.

<Production of Ground Calcium Carbonate 2a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 83% by volume. The flow rate was set to about 15 liters/min. The number of passes was set to 24. At this time, the mean particle diameter was 0.12 μm, the content of particles larger than 1.5 μm was zero, the cumulative frequency of ground calcium carbonate within a particle diameter range of 1.0 μm or less was 100% by volume, and the half value width of the maximum peak was 0.31 μm.

<Production of Ground Calcium Carbonate 2b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 83% by volume. The flow rate was set to about 15 liters/min. The number of passes was set to 24. At this time, the mean particle diameter was 0.12 μm, the content of particles larger than 1.5 μm was zero, the cumulative frequency of ground calcium carbonate within a particle diameter range of 1.0 μm or less was 100% by volume, and the half value width of the maximum peak was 0.13 μm.

<Production of Ground Calcium Carbonate 3a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 83% by volume. The flow rate was set to about 15 liters/min. The number of passes was set to 12. At this time, the mean particle diameter was 0.28 μm, the content of particles larger than 1.5 μm was zero, the cumulative frequency of ground calcium carbonate within a particle diameter range of 1.0 μm or less was 100% by volume, and the half value width of the maximum peak was 0.43 μm.

<Production of Ground Calcium Carbonate 3b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 83% by volume. The flow rate was set to about 15 liters/min. The number of passes was set to 12. At this time, the mean particle diameter was 0.28 μm, the content of particles larger than 1.5 μm was zero, the cumulative frequency of ground calcium carbonate within a particle diameter range of 1.0 μm or less was 100% by volume, and the half value width of the maximum peak was 0.25 μm.

<Production of Ground Calcium Carbonate 4a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 83% by volume. The flow rate was set to about 15 liters/min. The number of passes was set to 14. At this time, the mean particle diameter was 0.23 μm, the content of particles larger than 1.5 μm was zero, the cumulative frequency of ground calcium carbonate within a particle diameter range of 1.0 μm or less was 100% by volume, and the half value width of the maximum peak was 0.41 μm.

<Production of Ground Calcium Carbonate 4b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 83% by volume. The flow rate was set to about 15 liters/min. The number of passes was set to 14. At this time, the mean particle diameter was 0.23 μm, the content of particles larger than 1.5 μm was zero, the cumulative frequency of ground calcium carbonate within a particle diameter range of 1.0 μm or less was 100% by volume, and the half value width of the maximum peak was 0.23 μm.

<Production of Ground Calcium Carbonate 5a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 75% by volume. The flow rate was set to about 15 liters/min. The number of passes was set to 14. At this time, the mean particle diameter was 0.23 μm, the content of particles larger than 1.5 μm was zero, the cumulative frequency of ground calcium carbonate within a particle diameter range of 1.0 μm or less was 96% by volume, and the half value width of the maximum peak was 0.39 μm.

<Production of Ground Calcium Carbonate 5b>

Ground calcium carbonate was produced as follows. Natural limestone was coarsely crushed to a mean particle diameter of about 30 μm with a jaw crusher, hammer crusher and roller mill followed by granulating. water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 75% by volume. The flow rate was set to about 15 liters/min. The number of passes was set to 14. At this time, the mean particle diameter was 0.23 μm, the content of particles larger than 1.5 μm was zero, the cumulative frequency of ground calcium carbonate within a particle diameter range of 1.0 μm or less was 96% by volume, and the half value width of the maximum peak was 0.24 μm.

<Production of Ground Calcium Carbonate 6a>

Ground calcium carbonate was produced as follows. Natural limestone was coarsely crushed to a mean particle diameter of about 30 μm with a jaw crusher, hammer crusher and roller mill Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 79% by volume. The flow rate was set to about 15 liters/min. The number of passes was set to 17. At this time, the mean particle diameter was 0.19 μm, the content of particles larger than 1.5 μm was zero, the cumulative frequency of ground calcium carbonate within a particle diameter range of 1.0 μm or less was 98% by volume, and the half value width of the maximum peak was 0.34 μm.

<Production of Ground Calcium Carbonate 6b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 μm, and the bead packing ratio was 79% by volume. The flow rate was set to about 15 liters/min. The number of passes was set to 17. At this time, the mean particle diameter was 0.19 μm, the content of particles larger than 1.5 μm was zero, the cumulative frequency of ground calcium carbonate within a particle diameter range of 1.0 μm or less was 98% by volume, and the half value width of the maximum peak was 0.19 μm.

<Production of Ground Calcium Carbonate 7>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 78% by volume. The flow rate was set to about 15 liters/min. The number of passes was set to 12. At this time, the mean particle diameter was 0.25 μm, the content of particles larger than 1.5 μm was zero, the cumulative frequency of ground calcium carbonate within a particle diameter range of 1.0 μM or less was 97% by volume, and the half value width of the maximum peak was 0.31 μM.

<Production of Ground Calcium Carbonate 8a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 83% by volume. The flow rate was set to about 15 liters/min. The number of passes was set to 10. At this time, the mean particle diameter was 0.31 μm, the content of particles larger than 1.5 μm was zero, the cumulative frequency of ground calcium carbonate within a particle diameter range of 1.0 μm or less was 100% by volume, and the half value width of the maximum peak was 0.45 μm.

<Production of Ground Calcium Carbonate 8b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 83% by volume. The flow rate was set to about 15 liters/min. The number of passes was set to 10. At this time, the mean particle diameter was 0.31 μm, the content of particles larger than 1.5 μm was zero, the cumulative frequency of ground calcium carbonate within a particle diameter range of 1.0 μm or less was 100% by volume, and the half value width of the maximum peak was 0.33 μm.

<Production of Ground Calcium Carbonate 9>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 70% by volume. The flow rate was set to about 15 liters/min. The number of passes was set to 6. At this time, the mean particle diameter was 0.50 μm, the content of particles larger than 1.5 μm was zero, the cumulative frequency of ground calcium carbonate within a particle diameter range of 1.0 μm or less was 80% by volume, and the half value width of the maximum peak was 0.51 μm.

<Production of Ground Calcium Carbonate 10a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 83% by volume. The flow rate was set to about 15 liters/min. The number of passes was set to 34. At this time, the mean particle diameter was 0.07 μm, the content of particles larger than 1.5 μm was zero, the cumulative frequency of ground calcium carbonate within a particle diameter range of 1.0 μm or less was 100% by volume, and the half value width of the maximum peak was 0.26 μm.

<Production of Ground Calcium Carbonate 10b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 83% by volume. The flow rate was set to about 15 liters/min. The number of passes was set to 34. At this time, the mean particle diameter was 0.07 μm, the content of particles larger than 1.5 μm was zero, the cumulative frequency of ground calcium carbonate within a particle diameter range of 1.0 μm or less was 100% by volume, and the half value width of the maximum peak was 0.08 μm.

<Production of Ground Calcium Carbonate 11a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 70% by volume. The flow rate was set to about 15 liters/min. The number of passes was set to 14. At this time, the mean particle diameter was 0.26 μm, the content of particles larger than 1.5 μm was zero, the cumulative frequency of ground calcium carbonate within a particle diameter range of 1.0 μm or less was 93% by volume, and the half value width of the maximum peak was 0.42 μm.

<Production of Ground Calcium Carbonate 11b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 70% by volume. The flow rate was set to about 15 liters/min. The number of passes was set to 14. At this time, the mean particle diameter was 0.26 μm, the content of particles larger than 1.5 μm was zero, the cumulative frequency of ground calcium carbonate within a particle diameter range of 1.0 μm or less was 93% by volume, and the half value width of the maximum peak was 0.27 μm.

<Production of Ground Calcium Carbonate 12a>

Ground calcium carbonate was produced as follows. Natural limestone was coarsely crushed to a mean particle diameter of about 30 μm with a jaw crusher, hammer crusher and roller mill. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m). The beads used consisted of zirconia beads having a diameter of about 0.2 mm, and the bead packing ratio was 75% by volume. The flow rate was set to about 15 liters/min. The number of passes was set to 10. At this time, the mean particle diameter was 0.35 μm, the content of particles larger than 1.5 μm was zero, the cumulative frequency of ground calcium carbonate within a particle diameter range of 1.0 μm or less was 97% by volume, and the half value width of the maximum peak was 0.51 μm.

<Production of Ground Calcium Carbonate 12b>

Ground calcium carbonate was produced as follows. Natural limestone was coarsely crushed to a mean particle diameter of about 30 μm with a jaw crusher, hammer crusher and roller mill followed by granulating. Water and a commercially available polyacrylic acid-based dispersant were added thereto followed by stirring to obtain a preliminary dispersed slurry having a solid content of about 75% by mass. This preliminary dispersed slurry was processed using a wet crusher manufactured by Ashizawa Finetech Ltd. (horizontal type, dimensions of cylindrical crushing chamber: diameter of about 0.5 m, length of about 1.3 m) followed by granulating. The beads used consisted of zirconia beads having a diameter of about 0.2 mm, and the bead packing ratio was 75% by volume. The flow rate was set to about 15 liters/min. The number of passes was set to 10. At this time, the mean particle diameter was 0.35 μm, the content of particles larger than 1.5 μm was zero, the cumulative frequency of ground calcium carbonate within a particle diameter range of 1.0 μm or less was 97% by volume, and the half value width of the maximum peak was 0.38 μm.

<Production of Ground Calcium Carbonate 13>

A commercially available product (FMT-OP2A, Fimatec Ltd.) was used for the ground calcium carbonate. At this time, the mean particle diameter was 0.73 μm, the content of particles larger than 1.5 μm was 2.7% by volume, the cumulative frequency of ground calcium carbonate within a particle diameter range of 1.0 μm or less was 68% by volume, and the half value width of the maximum peak was 0.73 μm.

Ground calcium carbonate 1a to 6a, 1b to 6b and 7 constitute the ground calcium carbonate according to the present invention. Ground calcium carbonate 8a, 8b, 9, 10a to 12a, 10b to 12b and 13 constitute ground calcium carbonate that is not according to the present invention.

<Production of Support>

The support was produced in the manner indicated below. 10 parts by mass of filler in the form of precipitated calcium carbonate, 0.8 parts by mass of amphoteric starch, 0.8 parts by mass of aluminum sulfate and 1.0 parts by mass of alkyl ketene dimer sizing agent (Sizepine K903, Arakawa Chemical Industries, Ltd.) were added to a pulp slurry composed of 100 parts by mass of LBKP having freeness of 400 mlcsf followed by forming into paper using a Fourdrinier papermaking machine. Oxidized starch was adhered to both sides at 2.5 g/m$^2$ with a size press followed by processing with a machine calender to obtain raw paper having a basis weight of 100 g/m$^2$ for use as the support.

<Preparation of Coating Layer-Coating Colors>

Coating layer-coating colors were prepared according to the contents indicated below.

| | |
|---|---|
| Ground calcium carbonate and other pigment<br>Types and incorporated amounts as shown in Table 1 | |
| Styrene-butadiene copolymer latex (JSR-2605G, JSR Corp.) | 10 parts by mass |
| Starch phosphate (MS#4600, Nihon Shokuhin Kako Co., Ltd.) | 10 parts by mass |
| Printability improver (Sumirez Resin SPI-102A, Taoka Chemical Co., Ltd.) | 0.5 parts by mass |
| Acetylene glycol derivative or acetylene alcohol derivative<br>Types and incorporated amounts as shown in Table 1 | |

The aforementioned components were mixed and dispersed in water and the solid concentration was adjusted to 40% by mass.

The other pigments shown in Table 1 are as indicated below.

Precipitated calcium carbonate (TP123, Okutama Kogyo Co., Ltd., mean particle diameter: 0.63 μm)

Kaolin (HG90, J.M. Huber Corp., mean particle diameter: 0.19 μm)

Silica (silica prepared as described below was used)

Acetylene Glycol 1 (Olfine E1010, Nissin Chemical Co., Ltd., structural formula: Chemical formula 2)

Acetylene Glycol 2 (Surfynol 104E, Nissin Chemical Co., Ltd., structural formula: Chemical formula 1)

Acetylene Alcohol (Olfine B, Nissin Chemical Co., Ltd.)

<Preparation of Silica Dispersion>

4 parts by mass of a cationic polymer (dimethyldiallylammonium chloride homopolymer, Daiichi Kogyo Seiyaku Co., Ltd., Shallol DC902P, average molecular weight: 9000) and 100 parts by mass of precipitated silica (Nipsil VN3, Tosoh Silica Corp., mean secondary particle diameter: 23 μm) were mixed followed by preparing a preliminary dispersed slurry using a saw tooth blade type disperser (blade peripheral velocity: 30 m/sec). Next, the preliminary dispersed slurry was passed through a bead mill (zirconia beads, diameter: 0.3 mm, bead packing ratio: 82% by volume, disk peripheral velocity: 11 m/sec) once to adjust the silica concentration and prepare a silica dispersion having a silica solid concentration of 50% by mass. At this time, the mean particle diameter was 0.2 μm, the content of particles larger than 1.5 μm was zero, the cumulative frequency of silica within a particle diameter range of 1.0 μm or less was 96% by volume, and the half value width of the maximum peak was 0.23 μm.

<Production of Coated Paper>

A coating layer-coating color was coated onto both sides of the support with a blade coater and allowed to dry. Subsequently, the coated support was subjected to calendering treatment to produce Coated paper 1 to 40 used in the printed product manufacturing methods of Examples 1 to 28 and Comparative examples 1 to 20. The coating weight was 10 g/m$^2$ per side in terms of the solid fraction.

TABLE 1

| Coated paper | Coating layer | | | | | | |
|---|---|---|---|---|---|---|---|
| | Ground calcium carbonate | Incorporated amount (parts by mass) | Type of other pigment | Incorporated amount (parts by mass) | Printability improver (parts by mass) | Acetylene glycol derivative or acetylene alcohol derivative | Incorporated amount (parts by mass) |
| Coated paper 1 | 1a | 100 | None | 0 | 0.0 | — | 0.0 |
| Coated paper 2 | 2a | 100 | None | 0 | 0.0 | — | 0.0 |
| Coated paper 3 | 3a | 100 | None | 0 | 0.0 | — | 0.0 |
| Coated paper 4 | 4a | 100 | None | 0 | 0.0 | — | 0.0 |
| Coated paper 5 | 5a | 100 | None | 0 | 0.0 | — | 0.0 |
| Coated paper 6 | 6a | 100 | None | 0 | 0.0 | — | 0.0 |
| Coated paper 7 | 1a | 60 | Kaolin | 40 | 0.0 | — | 0.0 |
| Coated paper 8 | 1a | 80 | Kaolin | 20 | 0.0 | — | 0.0 |
| Coated paper 9 | 1a | 60 | Precipitated calcium carbonate | 40 | 0.0 | — | 0.0 |
| Coated paper 10 | 1b | 100 | None | 0 | 0.5 | Acetylene glycol 1 | 0.3 |
| Coated paper 11 | 2b | 100 | None | 0 | 0.5 | Acetylene glycol 1 | 0.3 |
| Coated paper 12 | 3b | 100 | None | 0 | 0.5 | Acetylene glycol 1 | 0.3 |
| Coated paper 13 | 4b | 100 | None | 0 | 0.5 | Acetylene glycol 1 | 0.3 |
| Coated paper 14 | 5b | 100 | None | 0 | 0.5 | Acetylene glycol 1 | 0.3 |
| Coated paper 15 | 6b | 100 | None | 0 | 0.5 | Acetylene glycol 1 | 0.3 |
| Coated paper 16 | 7 | 100 | None | 0 | 0.5 | Acetylene glycol 1 | 0.3 |
| Coated paper 17 | 1b | 60 | Kaolin | 40 | 0.5 | Acetylene glycol 1 | 0.3 |
| Coated paper 18 | 1b | 80 | Kaolin | 20 | 0.5 | Acetylene glycol 1 | 0.3 |
| Coated paper 19 | 1b | 60 | Precipitated calcium carbonate | 40 | 0.5 | Acetylene glycol 1 | 0.3 |
| Coated paper 20 | 1b | 100 | None | 0 | 0.5 | Acetylene glycol 2 | 0.3 |
| Coated paper 21 | 1b | 100 | None | 0 | 0.5 | Acetylene glycol 1 | 0.05 |
| Coated paper 22 | 1b | 100 | None | 0 | 0.5 | Acetylene glycol 1 | 1.0 |
| Coated paper 23 | 1b | 100 | None | 0 | 0.5 | — | 0.0 |
| Coated paper 24 | 1b | 100 | None | 0 | 0.5 | Acetylene alcohol | 0.3 |
| Coated paper 25 | 1a | 50 | Kaolin | 50 | 0.0 | — | 0.0 |
| Coated paper 26 | 8a | 100 | None | 0 | 0.0 | — | 0.0 |
| Coated paper 27 | 9 | 100 | None | 0 | 0.0 | — | 0.0 |
| Coated paper 28 | 10a | 100 | None | 0 | 0.0 | — | 0.0 |
| Coated paper 29 | 11a | 100 | None | 0 | 0.0 | — | 0.0 |
| Coated paper 30 | 12a | 100 | None | 0 | 0.0 | — | 0.0 |
| Coated paper 31 | — | 0 | Silica | 100 | 0.0 | — | 0.0 |
| Coated paper 32 | 1b | 50 | Kaolin | 50 | 0.5 | — | 0.0 |
| Coated paper 33 | 8b | 100 | None | 0 | 0.5 | — | 0.0 |
| Coated paper 34 | 9 | 100 | None | 0 | 0.5 | — | 0.0 |
| Coated paper 35 | 10b | 100 | None | 0 | 0.5 | — | 0.0 |
| Coated paper 36 | 11b | 100 | None | 0 | 0.5 | — | 0.0 |
| Coated paper 37 | 12b | 100 | None | 0 | 0.5 | — | 0.0 |
| Coated paper 38 | — | 0 | Silica | 100 | 0.5 | — | 0.0 |
| Coated paper 39 | 13 | 100 | None | 0 | 0.5 | — | 0.0 |
| Coated paper 40 | 13 | 100 | None | 0 | 0.5 | Acetylene glycol 1 | 0.3 |

The methods used to manufacture printed products consisted of the methods used in the examples and comparative examples in which printed products were manufactured by using each of the coated papers obtained according to the aforementioned procedure and printing using an industrial inkjet printer or printing using an offset printer before or after printing using an industrial inkjet printer.

(Printing Using Industrial Inkjet Printer)

Prescribed evaluation images were printed using the Prosper 5000XL Press manufactured by Eastman Kodak Co. for the industrial inkjet printer at a printing speed of 75 m/min, 100 m/min or 150 m/min, using water-based dye ink, and printing out 6000 m at each printing speed.

(Printing Using Offset Printer)

Prescribed evaluation images were repeatedly printed out 6000 m using an offset form rotary press manufactured by Miyakoshi Printing Machinery Co., Ltd. for the offset printer at a printing speed of 150 m/min, using T & K Toka UV Best Cure Black and Bronze Red Ink for the ink, and two UV irradiation sources at 8 kW either before or after printing with the aforementioned industrial inkjet printer.

(Evaluation of Printed Products)

Images of the printed products obtained in the manner described above were subjected to sensory evaluations. Evaluations were carried out on the finally obtained printed products. The degree of decrease in image quality caused by printing defects attributable to the occurrence of blanket piling in the case of offset printing, and the degree of decrease in image quality caused by insufficient ink fixation, insufficient ink absorption capacity, insufficient ink absorption rate or insufficient ink droplet diffusion in the case of industrial inkjet printing, were respectively observed visually and subjected to sensory evaluations to one of the four levels indicated below. In the present invention, an evaluation of AA or A was considered to constitute a printed product capable of being marketed as a commercial product.

AA: No decrease in image quality and having adequate image quality for marketing as a commercial product A: Slight decrease in image quality and having adequate image quality for marketing as a commercial product B: Slight decrease in image quality, but not having adequate image quality for marketing as a commercial product depending on the application C: Decrease in image quality and not having adequate image quality for marketing as a commercial product The respective evaluation results for Examples 1 to 28 and Comparative examples 1 to 20 are shown in Table 2.

TABLE 2

| Printed product manufacturing method | Coated paper | Printing | | Image quality of resulting printed products (industrial inkjet printing speed) | | |
|---|---|---|---|---|---|---|
| | | Initial printing | Subsequent printing | 75 m/min | 100 m/min | 150 m/min |
| Example 1 | Coated paper 1 | Inkjet | — | AA | A | A |
| Example 2 | Coated paper 2 | Inkjet | — | AA | A | A |
| Example 3 | Coated paper 3 | Inkjet | — | AA | A | A |
| Example 4 | Coated paper 4 | Inkjet | — | AA | A | A |
| Example 5 | Coated paper 5 | Inkjet | — | AA | A | A |
| Example 6 | Coated paper 6 | Inkjet | — | AA | A | A |
| Example 7 | Coated paper 7 | Inkjet | — | AA | A | A |
| Example 8 | Coated paper 8 | Inkjet | — | AA | A | A |
| Example 9 | Coated paper 9 | Inkjet | — | AA | A | A |
| Example 10 | Coated paper 1 | Inkjet | Offset | AA | A | A |
| Example 11 | Coated paper 1 | Offset | Inkjet | AA | A | A |
| Example 12 | Coated paper 10 | Inkjet | — | AA | AA | AA |
| Example 13 | Coated paper 11 | Inkjet | — | AA | AA | AA |
| Example 14 | Coated paper 12 | Inkjet | — | AA | AA | AA |
| Example 15 | Coated paper 13 | Inkjet | — | AA | AA | AA |
| Example 16 | Coated paper 14 | Inkjet | — | AA | AA | AA |
| Example 17 | Coated paper 15 | Inkjet | — | AA | AA | AA |
| Example 18 | Coated paper 16 | Inkjet | — | A | A | A |
| Example 19 | Coated paper 17 | Inkjet | — | A | A | A |
| Example 20 | Coated paper 18 | Inkjet | — | AA | A | A |
| Example 21 | Coated paper 19 | Inkjet | — | AA | A | A |
| Example 22 | Coated paper 10 | Inkjet | Offset | AA | AA | AA |
| Example 23 | Coated paper 10 | Offset | Inkjet | AA | AA | AA |
| Example 24 | Coated paper 20 | Inkjet | — | AA | AA | AA |
| Example 25 | Coated paper 21 | Inkjet | — | AA | AA | AA |
| Example 26 | Coated paper 22 | Inkjet | — | AA | AA | AA |
| Example 27 | Coated paper 23 | Inkjet | — | AA | AA | A |
| Example 28 | Coated paper 24 | Inkjet | — | AA | AA | A |
| Comparative Example 1 | Coated paper 25 | Inkjet | — | B | B | C |
| Comparative Example 2 | Coated paper 26 | Inkjet | — | C | C | C |
| Comparative Example 3 | Coated paper 27 | Inkjet | — | C | C | C |
| Comparative Example 4 | Coated paper 28 | Inkjet | — | C | C | C |
| Comparative Example 5 | Coated paper 29 | Inkjet | — | C | C | C |
| Comparative Example 6 | Coated paper 30 | Inkjet | — | C | C | C |
| Comparative Example 7 | Coated paper 29 | Inkjet | Offset | C | C | C |
| Comparative Example 8 | Coated paper 29 | Offset | Inkjet | C | C | C |
| Comparative Example 9 | Coated paper 31 | Inkjet | — | C | C | C |
| Comparative Example 10 | Coated paper 32 | Inkjet | — | B | B | B |
| Comparative Example 11 | Coated paper 33 | Inkjet | — | C | C | C |
| Comparative Example 12 | Coated paper 34 | Inkjet | — | C | C | C |
| Comparative Example 13 | Coated paper 35 | Inkjet | — | C | C | C |
| Comparative Example 14 | Coated paper 36 | Inkjet | — | C | C | C |
| Comparative Example 15 | Coated paper 37 | Inkjet | — | C | C | C |
| Comparative Example 16 | Coated paper 36 | Inkjet | Offset | C | C | C |
| Comparative Example 17 | Coated paper 36 | Offset | Inkjet | C | C | C |
| Comparative Example 18 | Coated paper 38 | Inkjet | — | C | C | C |
| Comparative Example 19 | Coated paper 39 | Inkjet | — | C | C | C |
| Comparative Example 20 | Coated paper 40 | Inkjet | — | B | B | C |

As can be seen from Table 2, according to the present invention, Examples 1 to 28, which are equivalent to the method for manufacturing printed products using an industrial inkjet printer of the present invention, were determined to be able to manufacture printed products which have adequate image quality for marketing as commercial products and can be marketed as commercial products. In addition, according to the present invention, even if printed products were printed using a conventional printer other than an industrial inkjet printer such as an offset printer either before or after printing using an industrial inkjet printer, the present manufacturing method were also determined to be able to manufacture printed products which have adequate image quality for marketing as commercial products and can be marketed as commercial products.

As a result of comparing Examples 1 to 11 and 18 having a half value width greater than 0.25 μm with Examples 12 to 17 and 19 to 28 having a half value width of 25 μm or less, it was determined that, if ground calcium carbonate having a cumulative frequency of a particle diameter of 1.0 μm or less in a volume-based particle size distribution of 95% by volume and having a mean particle diameter of 0.1 μm to 0.28 μm has at least one peak and the half value width of the maximum peak thereof of 0.25 μm or less in a particle size distribution curve thereof, printed products can be manufactured more favorably.

As a result of comparing Examples 27 and 28 with Examples 12 to 17 and Examples 24 to 26, it was determined that printed products can be more favorably manufactured if the coating layer of the coated paper contains an acetylene glycol derivative.

On the other hand, Comparative examples 1 to 20, which are not equivalent to the method for manufacturing printed products using an industrial inkjet printer of the present invention, did not allow the manufacturing of printed products capable of being marketed as commercial products due to inadequate image quality for marketing as commercial products.

The invention claimed is:

1. A method for manufacturing a printed product using an industrial inkjet printer, comprising:

a step for printing on coated printing paper using an industrial inkjet printer, wherein the printing speed of the industrial inkjet printer is 60 m/min or more, the coated printing paper contains Et support and Et coating layer, and the coating layer contains ground calcium carbonate, having a cumulative frequency of a particle diameter of 1.0 μm or less in a volume-based particle size distribution of 95% by volume or more and a mean particle diameter of 0.1 μm to 0.28 μm, at 60% by mass or more of the total amount of pigment in the coating layer.

2. The method for manufacturing a printed product using an industrial inkjet printer according to claim 1, further comprising a step for printing using a printer other than the industrial inkjet printer, selected from a gravure printer, an offset printer, a letterpress printer, a flexographic printer, a thermal transfer printer and a toner printer, before or after the step for printing on the coated printing paper using an industrial inkjet printer.

3. The method for manufacturing a printed product using an industrial inkjet printer according to claim 2, wherein the printer other than the industrial inkjet printer is an offset printer.

4. The method for manufacturing a printed product using an industrial inkjet printer according to claim 3, wherein the ground calcium carbonate having a cumulative frequency of a particle diameter of 1.0 μm or less in a volume-based particle size distribution of 95% by volume or more and a mean particle diameter of 0.1 μm to 0.28 μm has at least one peak in a particle size distribution curve thereof, and has a half value width of a maximum peak thereof of 0.25 μm or less.

5. The method for manufacturing a printed product using an industrial inkjet printer according to claim 3, wherein the coating layer contains an acetylene glycol derivative.

6. The method for manufacturing a printed product using an industrial inkjet printer according to claim 2, wherein the ground calcium carbonate having a cumulative frequency of a particle diameter of 1.0 μm or less in a volume-based particle size distribution of 95% by volume or more and a mean particle diameter of 0.1 μm to 0.28 μm has at least one peak in a particle size distribution curve thereof, and has a half value width of a maximum peak thereof of 0.25 μm or less.

7. The method for manufacturing a printed product using an industrial inkjet printer according to claim 2, wherein the coating layer contains an acetylene glycol derivative.

8. The method for manufacturing a printed product using an industrial inkjet printer according to claim 1, wherein the ground calcium carbonate having a cumulative frequency of a particle diameter of 1.0 μm or less in a volume-based particle size distribution of 95% by volume or more and a mean particle diameter of 0.1 μm to 0.28 μm has at least one peak in a particle size distribution curve thereof, and has a half value width of a maximum peak thereof of 0.25 μm or less.

9. The method for manufacturing a printed product using an industrial inkjet printer according to claim 8, wherein the coating layer contains an acetylene glycol derivative.

10. The method for manufacturing a printed product using an industrial inkjet printer according to claim 1, wherein the coating layer contains an acetylene glycol derivative.

* * * * *